US010640974B2

(12) United States Patent
Chigot et al.

(10) Patent No.: US 10,640,974 B2
(45) Date of Patent: May 5, 2020

(54) SURFACE FORMING SYSTEM

(71) Applicant: SAINT-GOBAIN ECOPHON AB, Hyllinge (SE)

(72) Inventors: Pierre Chigot, Helsingborg (SE); Emma Arvidsson, Helsingborg (SE)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 0 days.

(21) Appl. No.: 15/759,653

(22) PCT Filed: Sep. 8, 2016

(86) PCT No.: PCT/EP2016/071214

§ 371 (c)(1),
(2) Date: Mar. 13, 2018

(87) PCT Pub. No.: WO2017/045999

PCT Pub. Date: Mar. 23, 2017

(65) Prior Publication Data

US 2019/0048587 A1 Feb. 14, 2019

(30) Foreign Application Priority Data

Sep. 18, 2015 (EP) ..... 15185927

(51) Int. Cl.
*E04B 9/04* (2006.01)
*E04B 9/18* (2006.01)
(Continued)

(52) U.S. Cl.
CPC ..... *E04B 9/0414* (2013.01); *E04B 9/18* (2013.01); *E04B 9/003* (2013.01); *E04B 9/34* (2013.01)

(58) Field of Classification Search
CPC ..... E04B 9/18; E04B 9/003; E04B 9/0414
(Continued)

(56) References Cited

U.S. PATENT DOCUMENTS 3,466,830 A * 9/1969 Smith Ving ..... E04B 9/003 160/183
3,494,092 A * 2/1970 Bottjer ..... E04B 1/04 52/125.4

(Continued)

FOREIGN PATENT DOCUMENTS

DE 20304506 U1 8/2003
EP 0602334 A1 6/1994

(Continued)

OTHER PUBLICATIONS

International Search Report form International Application No. PCT/EP2016/071214 dated Nov. 16, 2016.

*Primary Examiner* — Paola Agudelo
(74) *Attorney, Agent, or Firm* — Brundidge & Stanger, P.C.

(57) ABSTRACT

The present invention relates to a surface forming system intended to be supported by a structural ceiling and/or a wall of a room. The surface forming system comprises a first tile and a second tile, each tile comprising a front major surface, an opposing back major surface and at least one edge surface extending along the perimeter of the tile and connecting the front and back major surfaces, a first connecting member and a second connecting member, each comprising a tile connector and a pivot connector, wherein the tile connector of the first connecting member and the second connecting member are connected to the first tile and the second tile, respectively, and wherein the pivot connector of the first and the second connecting members are pivotably connected to each other such that the tiles are foldable relative each other. The invention further relates to a method for installation of a surface forming system supported by a structural ceiling and/or wall of a room.

7 Claims, 3 Drawing Sheets

(51) Int. Cl.
*E04B 9/00* (2006.01)
*E04B 9/34* (2006.01)

(58) Field of Classification Search
USPC ..... 52/506.06
See application file for complete search history.

(56) References Cited

U.S. PATENT DOCUMENTS 3,724,157 A * 4/1973 Miram ..... E04B 1/04 52/125.4
7,406,802 B2 * 8/2008 Stackenwalt ..... E04B 9/0414 52/22
7,679,222 B2 * 3/2010 Patterson ..... H02G 3/00 174/480
2004/0226241 A1 * 11/2004 Forster ..... A63C 19/10 52/384
2005/0011150 A1 * 1/2005 Stackenwalt ..... E04B 9/00 52/311.1
2005/0223666 A1 * 10/2005 Forster ..... E01C 5/20 52/392
2008/0307724 A1 * 12/2008 Krantz-Lilienthal ..... E04B 9/0414 52/222
2011/0146183 A1 * 6/2011 Wilkens ..... E04B 9/0414 52/506.06
2013/0186023 A1 * 7/2013 Nobile ..... E04B 2/7427 52/242
2013/0186038 A1 * 7/2013 Lang ..... E05D 15/26 52/745.16
2017/0073968 A1 * 3/2017 Kilian ..... E04B 9/225
2017/0275878 A1 * 9/2017 Chigot ..... E04B 9/04

FOREIGN PATENT DOCUMENTS

EP 2339083 A1 6/2011
JP 2010030651 A 2/2010
WO 9823498 A1 6/1998
WO 03/035991 A2 5/2003
WO 2013/134340 A1 9/2013

* cited by examiner

SURFACE FORMING SYSTEM

FIELD OF THE INVENTION

The present invention relates to a surface forming system intended to be supported by a structural ceiling and/or a wall of a room. The invention further relates to a method for installation of a surface forming system supported by a structural ceiling and/or wall of a room.

TECHNICAL BACKGROUND

Suspended ceilings, or other interior surfaces, can be installed in many different types of buildings for various reasons, for example to absorb sound, to reflect light, to lower the ceiling height or to conceal installations such as cable arrangements, ventilation equipment, lighting installations and other devices arranged in the space between the suspended ceiling and the structural ceiling of a room, or to provide an aesthetically appealing surface.

It is known to install a suspended ceiling in buildings by using a grid system mounted to the ceiling to which grid system ceiling tiles are fastened.

Suspended ceilings typically consist of a plurality of tiles suspended from the structural ceiling. It is a problem to achieve well defined gaps between the tiles, and to achieve parallel side edges of adjacent tiles of suspended ceilings. It is particularly problematic to achieve well defined gaps and parallel side edges with non-planar ceilings, irregularly shaped structural ceilings, non-rectangular tiles, and/or irregularly shaped or sized tiles.

There is a need for a surface forming system supported by a structural ceiling which efficiently may be used with irregularly shaped structural ceilings, non-rectangular tiles, and/or irregularly shaped or sized tiles.

SUMMARY OF THE INVENTION

It is an object of the present invention to provide an improvement over the above described techniques and prior art.

It is a further object of the present invention to provide a surface forming system intended to be supported by a structural ceiling which efficiently may be used with irregularly shaped structural ceilings, non-rectangular tiles, and/or irregularly shaped or sized tiles.

According to an aspect, there is provided a surface forming system intended to be supported by a structural ceiling and/or a wall of a room. The surface forming system comprises a first tile and a second tile, each tile comprising a front major surface, an opposing back major surface and at least one edge surface extending along the perimeter of the tile and connecting the front and back major surfaces, a first connecting member and a second connecting member, each comprising a tile connector and a pivot connector, wherein the tile connector of the first connecting member and the second connecting member are connected to the first tile and the second tile, respectively, and wherein the pivot connector of the first and the second connecting members are pivotably connected to each other such that the tiles are foldable relative each other.

With such a system a surface comprising a plurality of tiles of desired shapes may be formed. Adjacent tiles may be efficiently connected with predetermined gaps and parallel side edges, even when they are part of an un-even, such as non-planar, surface, and even when the structural ceiling and/or wall is irregularly or non-planar shaped. A first connecting member and a second connecting member are efficient for connecting of adjacent tiles. The tile connectors makes it possible to connect the connecting members to tiles. The pivot connectors makes it possible to pivotably connect the connecting members, and, thus, efficiently make the tiles foldable relative to each other. The connecting members, further, Such a surface forming system with tiles being foldable relative each other provides for efficient forming of surfaces including non-planar surfaces. The surface forming system may be supported by a structural ceiling and/or a wall of a room by hinge member(s) being connectable to the structural ceiling and/or the wall of a room. It will be understood that such a system efficiently allows the surface to be formed, at least in part due to the hinge members which allows the tiles to efficiently be connected such that they form a planar or a non-planar surface with desired angling between adjacent tiles. In addition, the system provides for control of the gap between adjacent tiles. The tiles being foldable relative each other allows the tiles to adapt to desired and/or predetermined shape of the formed surface.

The first and the second tile may be comprising of compressed fibre material.

The compressed fibre material may be compressed mineral fibre material.

Such compressed fibre materials provides efficient properties to the tiles.

The pivot connector of the first and the second connecting members may be pivotably connected to each other for forming a hinge joint. Such a hinge joint efficiently makes the tiles foldable relative each other. Further, the system with such a hinge joint efficiently allows adjacent tiles to be installed with parallel edge surfaces.

The hinge joint may be positioned in a space formed between the at least one edge surface of the first and the second tiles. The system with such a hinge joint efficiently allows adjacent tiles to be installed with parallel edge surfaces.

The surface forming system may further comprise a first hinge member, and the pivot connector of the first and the second connecting members may be pivotably connected to each other via the hinge member. Thus, an efficient pivotable connection between the pivot connectors may efficiently be provided.

The hinge member may be connectable to the structural ceiling and/or the wall. Thus, a surface, for example in the form of a ceiling and/or wall, may efficiently be formed. Further, the surface forming system may efficiently be supported by a structural ceiling and/or a wall of a room The tile connector of the first and second connecting members may be inserted in a slit or groove of the at least one edge surface of the first and the second tiles, respectively, or attached to a major surface of the first and the second tiles, respectively. Thus, tiles may be connected in an efficient and predetermined manner.

Each of the first and the second connecting members may have a lip or shoulder arranged to abut the at least one edge surface of the first and the second tiles, respectively, such that a predetermined space is formed between the at least one edge surface of the first and the second tiles.

The first and the second connecting members may be made of sheet structure or wire structure.

The sheet structure may be sheet metal or sheet plastic.

The wire structure may be bent metal wire or bent plastic wire or rod.

Such connecting members may efficiently be produced and are durable and efficient.

One or both of the front major surface and the opposing back major surface of each of the first tile and the second tiles may be planar.

The first and the second connecting members may be made of bend metal wire, the tile connectors of the first and the second connecting members may each comprise a planar portion inserted in a slit or groove of the at least one edge surface of the first and the second tiles, respectively, and the pivot connectors of the first and the second connecting members may each comprise at least one protruding member inserted in corresponding orifices of the first hinge member whereby the pivot connector of the first and the second connecting members are pivotably connected to each other via the hinge member.

According to another aspect, there is provided a method for installation of a surface forming system supported by a structural ceiling and/or wall of a room. The method comprises attaching a first hinge member to the structural ceiling and/or wall; connecting a tile connector of a first connecting member to a first tile; connecting a tile connector of a second connecting member to a second tile; connecting a pivot connector of the first connecting member to the first hinge member; and connecting a pivot connector of the second connecting member to the first hinge member, whereby the first and second tiles are foldable relative each other by pivoting about said first hinge member.

The method may further comprise attaching a second and a third hinge member to the structural ceiling and/or wall; connecting a tile connector of a third connecting member to the first tile; connecting a tile connector of a fourth connecting member to the second tile; connecting a pivot connector of the third connecting member to the second hinge members; and connecting a pivot connector of the fourth connecting member to the third hinge member.

With the method a surface comprising a plurality of tiles may efficiently be formed.

The fastening the hinge members to the structural ceiling and/or wall may be prior to the remaining steps of the method, and connecting the connecting members to the tiles may be made prior to connecting the connecting members to the hinge members.

Further features of, and advantages with, the present invention will become apparent when studying the appended claims and the following description. The skilled person will realise that different features of the present invention may be combined to create embodiments other than those described in the following, without departing from the scope of the present invention. Features of one aspect may be relevant to anyone of the other aspects, references to these features are hereby made.

BRIEF DESCRIPTION OF THE DRAWINGS

The present invention will by way of example be described in more detail with reference to the appended schematic drawings, which show embodiments of the present invention.

DETAILED DESCRIPTION

With the embodiments it is made possible to efficiently form a surface, such as a suspended ceiling or wall, from a plurality of tiles, wherein the surface is having a desired shape. The tiles being foldable relative each other enables efficient formation of, for example, non-planar surfaces. Further, a predetermined gap between adjacent tiles may efficiently be realised. The surface forming system benefits from the tiles being foldable relative each other and, thus, efficiently may adapt to a non-plain or irregularly shaped surface, and, in addition, that adjacent tiles are connected to each other with a predetermined gap.

Figure 1:
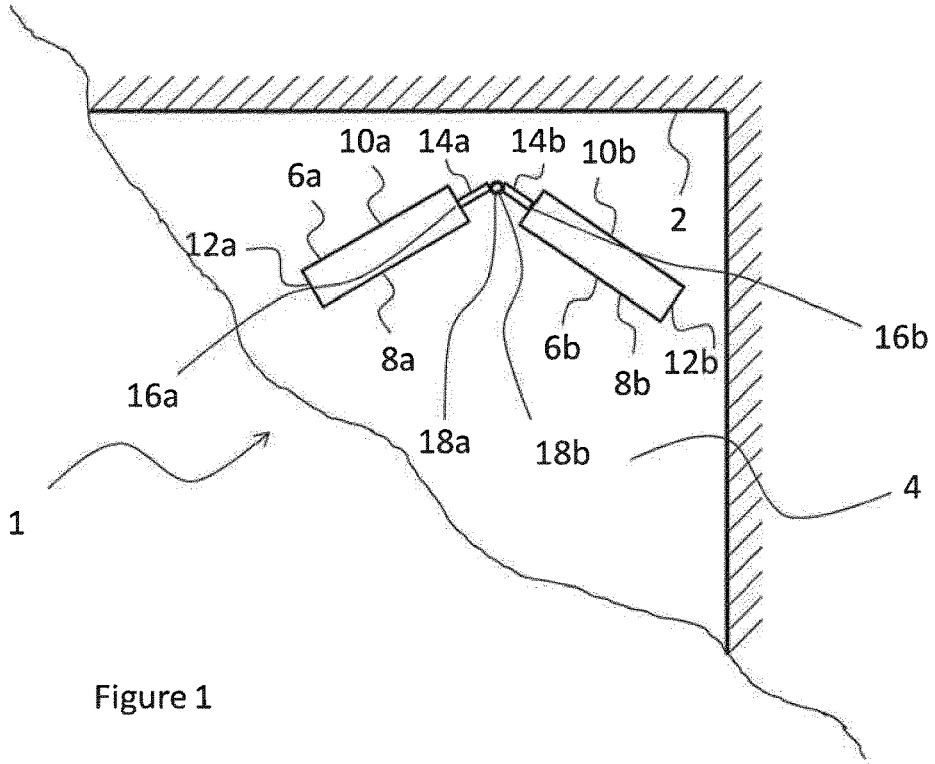
FIG. 1 illustrates a side view of a surface forming system according to an embodiment.

With reference to FIG. 1, a surface forming system 1 intended to be supported by a structural ceiling 2 and/or a wall 3 of a room 4 will now be discussed. The surface forming system 1 has a first tile 6*a* and a second tile 6*b*. Each tile 6*a*,6*b* has a front major surface 8*a*,8*b*, an opposing back major surface 10*a*,10*b* and at least one edge surface 12*a*,12*b* extending along the perimeter of the tile 6*a*, 6*b* and connecting the front and back major surfaces 8*a*,8*b*,10*a*,10*b*. The surface forming system 1 further has a first connecting member 14*a* and a second connecting member 14*b*, each comprising a tile connector 16*a*,16*b* and a pivot connector 18*a*,18*b*, wherein the tile connector 16*a*,16*b* of the first connecting member 14*a* and the second connecting member 14*b* are connected to the first tile 6*a* and the second tile 6*b*, respectively. The pivot connector 18*a*,18*b* of the first and the second connecting members 14*a*,14*b* are pivotably connected to each other such that the tiles 6*a*,6*b* are foldable relative each other. The connection of the surface forming system 1 to the structural ceiling 2 and/or a wall 3 of a room 4 is not illustrated in FIG. 1.

Figure 2:
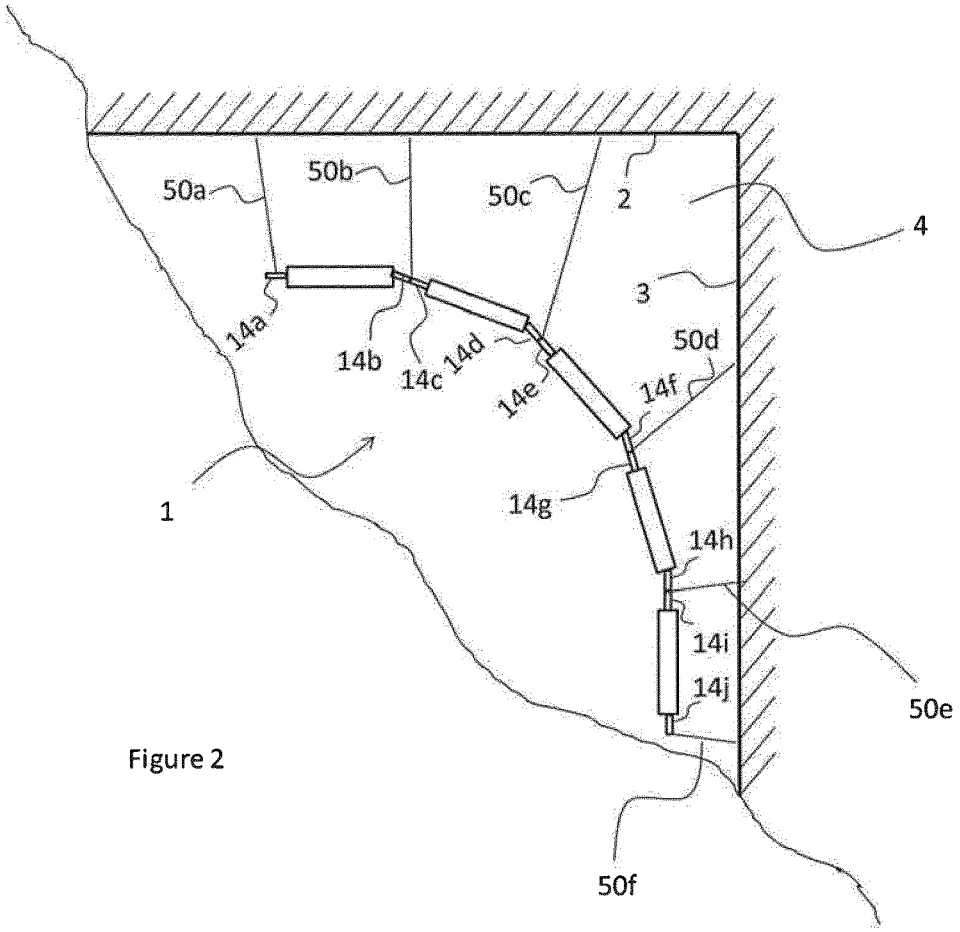
FIG. 2 illustrates a side view of a surface forming system according to an embodiment.

FIG. 2 illustrates a cross-section of a room 4 having a surface in the form of a suspended ceiling formed by the surface forming system 1 according to an embodiment. The surface is supported by the structural ceiling 2 and wall 3 of a room 4, by structure connectors 50*a-f* linking the connecting members 14*a-j* and the structural ceiling 2 and wall 3, although other suitable ways of supporting the surface may be used. Structure connectors 50*a-f* provides a fixed reference point for the tiles, and thereby allowing fastening of the tiles in a fixed relationship with the room 4. Further, the structure connectors may be designed to provide a surface with any suitable shape and essentially independent of the shape of the structural ceiling and/or wall. Alternatively, the connecting members 14 may be directly linked to the structural ceiling 2 and/or wall 3 by suitable fastening means. Such direct linking may be used, for example, if the surface formed by the tiles 6 is intended to follow the shape of the structural ceiling 2 and/or wall 3.

The embodiment discussed with reference to FIG. 2 illustrates that a non-planar surface, in this example a curved surface, efficiently may be formed. Although FIG. 2 only illustrates a curved line of the cross section of the ceiling it is realised that the surface may be curved in three dimensions. For example, the surface may be spherical, or take any suitable form. Tiles being foldable relative to adjacent tiles as a result of the pivot connectors results in efficient installation of the curved ceiling. In addition, predetermined gaps and parallel side edges between adjacent tiles may be realised. By suitable selection of structure connectors 50, and sizes and shapes of tiles, a desired shape of the surface may be formed.

According to an embodiment, the surface is supported by the structural ceiling and/or wall 2 of a room 4, by structure connectors 50 linking the connecting members 14 and the structural ceiling 2 and/or wall 3.

By selecting suitably designed structure connectors 50 and connecting them suitably to the structural ceiling 2 and/or wall 3, the form of the surface may be formed simply by installing the tiles to the connectors, and, thus, efficient installation is realised.

Different surface forming systems according to embodiments will now be described with reference to FIGS. 3 to 6. It will be realised that different connecting members and hinge joints may provide foldable tiles with parallel side edges, which, thus, may be used for forming surfaces of desired shapes.

Figure 3:
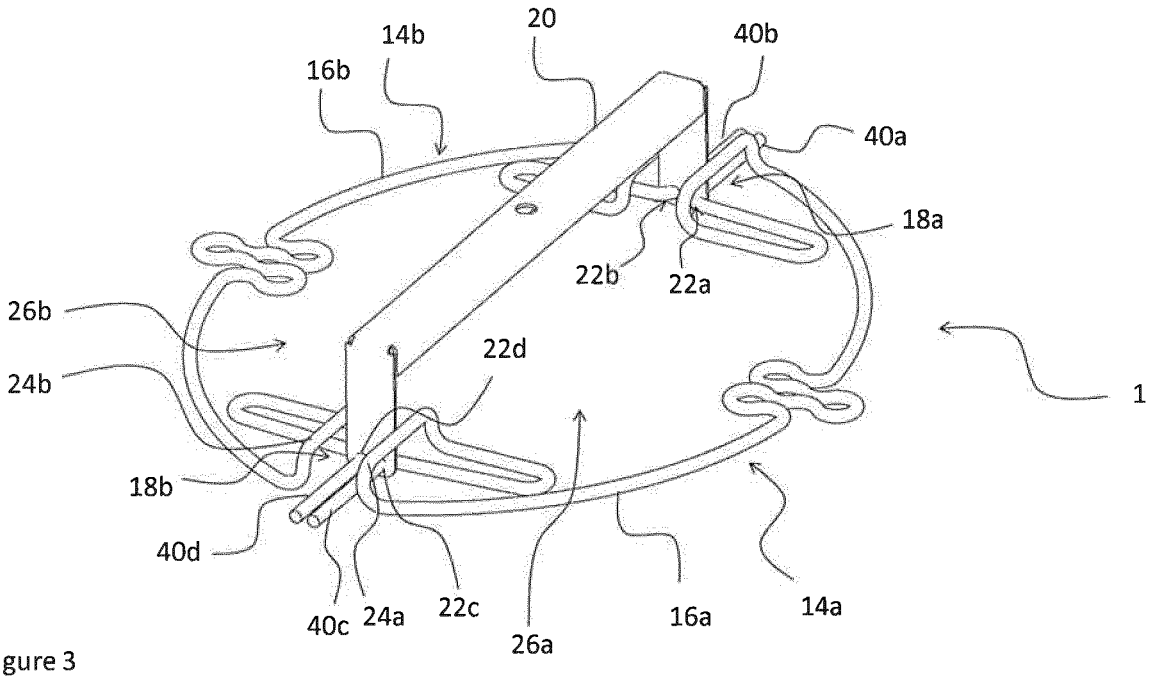
FIG. 3 illustrates a perspective view of a surface forming system according to an embodiment.

With reference to FIG. 3, a surface forming system 1 intended to be supported by a structural ceiling 2 and/or a wall 3 of a room 4 according to an embodiment will now be discussed. In order to improve clarity, the tiles are not illustrated. The first and second connecting members 14*a,b* has tile connectors 16*a,b* and pivot connectors 18*a,b*. The connecting members 14*a,b* according to this embodiment are made of bent metal wire defining a major portion in planes 26*a,b*. Although the connecting members 14*a,b* each is made of a single piece of bend metal wire it is realised that it may be comprised of a plurality of bent metal wires suitably connected to form the connecting member.

The pivot connectors 18*a,b* each comprises at least one protruding member 40*a-d* inserted through holes 22*a-d* of the hinge member 20, which hinge member 20 is made of sheet metal. Thereby, the first and the second connecting members 14*a,b* are foldable relative each other. The pivot connectors 18*a,b* are pivotably connected for forming a hinge joint. The illustrated connecting members 14*a,b* each has a pivot connector 18*a,b* each comprising two protruding members 40*a-d*. The tile connectors 16*a,b* are connectable to tiles 6*a,b*, which, for clarity reasons, are not illustrated in FIG. 3. In this embodiment, the tile connectors 16*a,b* are intended to be inserted in slits or grooves of the at least one edge surface 12*a,b* of each tiles 6*a,b*, respectively, similar to discussions referring to FIG. 4, but, alternatively, they may each be attached to a major surface of a tile.

The connecting members 14*a,b* have shoulders 24*a,b* arranged to abut edge surfaces 12*a,b* of the tiles, thereby predetermined spaces are formed between the edge surface 12*a* of the first tile 6*a* connected to the first connecting member 14*a* and the edge surface 12*b* of the second tile 6*b*.

It is realised that according to alternative embodiments, the first and the second connecting members 14*a,b* may be pivotably connected to each other such that the tiles 6*a*,6*b* are foldable relative each other without a hinge member 20.

The hinge member 20, such as the hinge members 20 illustrated in FIGS. 3 to 6, may be connectable directly to the structural ceiling 2 and/or the wall 3; or may be connectable indirectly via a structure connector, thereby providing a fixed reference point for the tiles 6*a,b*, and thereby allowing fastening of the tiles 6*a,b* in a fixed relationship with the room 4.

Figure 4:
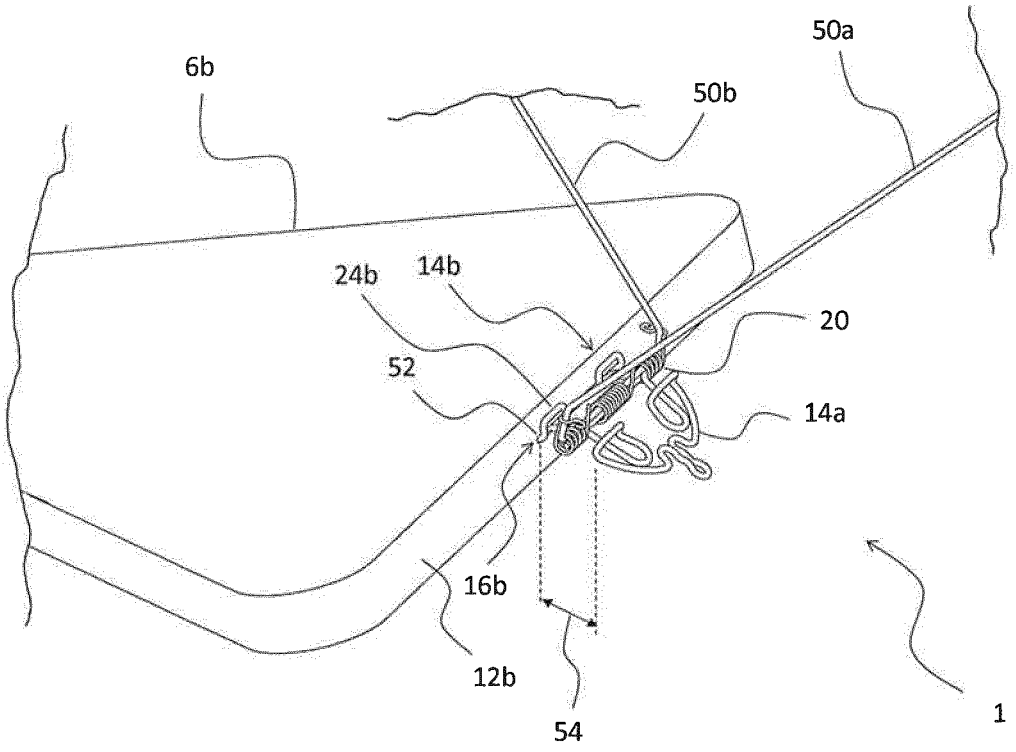
FIG. 4 illustrates a perspective view of a surface forming system according to an embodiment.

With reference to FIG. 4, a surface forming system 1 supported by a structural ceiling 2 and/or wall 3 (not illustrated) is illustrated to indicate one embodiment of connecting a tile 6*b*. The system 1 is illustrated with one tile 6*b*, although it is realised that the system may comprise further tiles. Both connecting members 14*a,b* are identical, and made of bent metal wire similar to the embodiment illustrated with reference to FIG. 3. A part of connecting member 14*b* is obscured by the tile 6*b*. The hinge member 20 of the illustrated embodiment comprises metal wire comprising spirals, and according to this embodiment two structure connectors 50*a,b* are linking the connecting members 14*a,b* to a structural ceiling 2 and/or wall 3. The structure connector 50*a,b* are linked to different points of the structural ceiling 2 and/or wall 3*a*. The tile connector 16*b* of connecting member 14*b* is inserted into a slit 52 of the tile 6*b*, and shoulders 24*b* of connecting member 14*b* abuts one edge surface 12*b* of the tile 6*b*. Although only one tile, tile 6*b*, is illustrated to improve visibility of details of the system 1, it will be understood from FIG. 4 that, thus, a predetermined space or gap efficiently is provided between tiles connected to the connectors 14*a,b*, as indicated by arrow 54. Further it may be noted from FIG. 4 that the embodiment is illustrated with part of a triangularly shaped tile 6*b*.

Figure 5:
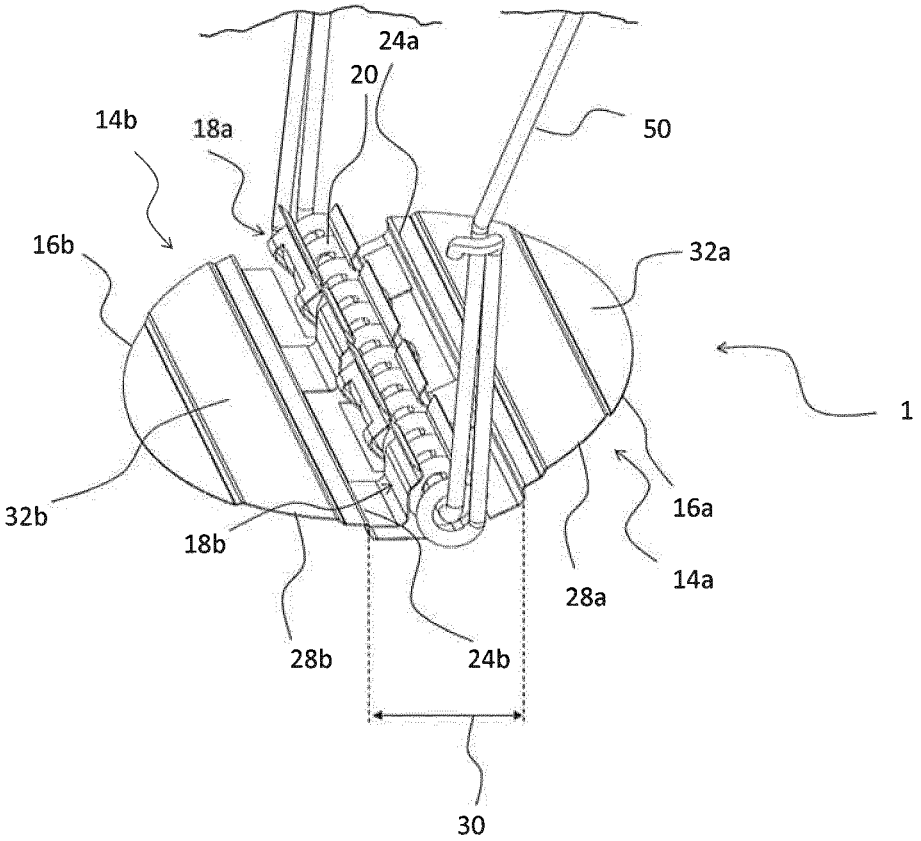
FIG. 5 illustrates a perspective view of a surface forming system according to an embodiment.

With reference to FIG. 5, a surface forming system 1 intended to be supported by a structural ceiling 2 and/or a wall 3 of a room 4 will now be discussed. First and second tiles 6*a*,6*b* have not been illustrated in an attempt to improve the visibility of details of the system. I will be understood that the tile connectors 16*a,b* may be connected to tiles for example by being inserted in slits 52 of tiles 6*a,b* similarly to what is illustrated and discussed with reference to FIG. 4. The system 1 has a first connecting member 14*a* and a second connecting member 14*b*, both made of sheet metal. Each connecting member 14*a,b* has a tile connector 16*a,b* which is inserted into a slit 52 of the tile it connects. A corrugation 28*a,b* of the tile connectors 16*a,b* are provided for locking the tile connectors 16*a,b* in place when inserted into the slits. Each of the first and the second connecting members 14*a,b* have a lip or shoulder 24*a,b* which abut the edge surface of the first and the second tiles 6*a,b*, respectively, such that a predetermined space is formed between the at least one edge surface of the first and the second tiles, as indicated by arrow 30. Each of the first and the second connecting members 14*a,b* further have pivot connectors 18*a,b* pivotably connected to each other such that the tiles are foldable relative each other. The pivot connectors 18*a,b* are connected to hinge member 20. The pivot connectors 18*a,b* comprise resilient clips which in part circumferes the hinge member 20 which is in the form of a spring or spiral secured to structure connector 50 linking the connecting members 14*a*,14*b* and the not illustrated structural ceiling/wall 2. It is realised that one or both of the tile connectors 16*a,b* could have been attached to a major surface of the tile(s) 6*a,b* instead of having been inserted into slits. The connecting members 14*a,b* have planar portions 32*a,b* in a shape of a circular segment, thereby facilitating efficient insertion in the slits of the tiles 6*a,b*.

Figure 6:
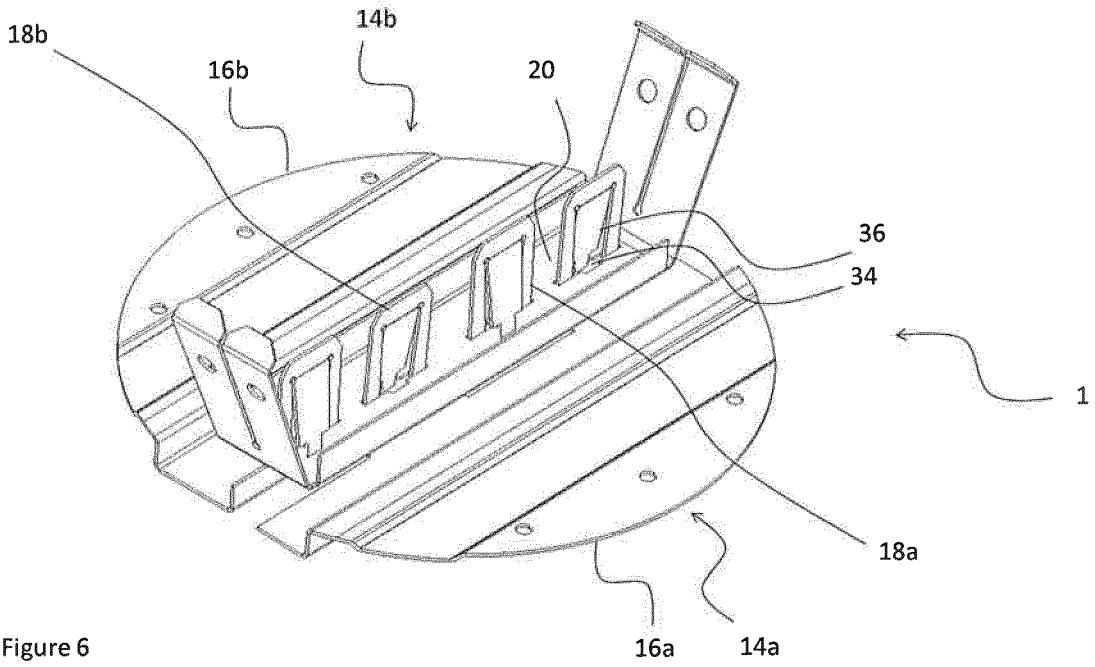
FIG. 6 illustrates a perspective view of a surface forming system according to an embodiment.

With reference to FIG. 6, first and second connecting members 14*a,b* and a hinge member 20 of a surface forming system 1 according to an embodiment will now be discussed. In order to improve clarity, the tiles are not illustrated. The connecting members 14*a,b* are made of sheet metal. The connecting members 14*a,b* have tile connectors 16*a,b* similar to the tile connectors 16*a,b* discussed with reference to FIG. 5. The tile connectors 16*a,b* are intended to be inserted into slits of the tiles, or to major surfaces of the tiles. The connecting members 14*a,b* further have pivot connectors 18*a,b* connectable to the hinge member 20 by inserting through corresponding openings 34 until resilient locking members 36 snaps such that it releasably locks pivot connectors 18*a,b* to hinge member 20. It will be appreciated that the connecting members 14*a,b* thereby are pivotably connected to each other such that connected tiles are foldable relative each other.

It will be realised from the discussions above with reference to FIGS. 1 to 6 that a surface comprising tiles, such as a suspended ceiling, efficiently may be installed. As one result of the connecting members well defined gaps between the tiles, and parallel side edges of adjacent tiles may efficiently be realised and non-planar ceilings, irregularly shaped structural ceilings, may be realised, even with non-rectangular tiles, and/or irregularly shaped or sized tiles.

The tile connector of the first and the second connecting members may be made of metal wire defining a major portion in a plane.

The tile connector of the first and the second connecting members may be made of sheet metal and comprises a planar portion, preferably tapered in a plane. Thereby, efficient insertion in the slit is facilitated.

The tile connector may be profiled, such as by comprising corrugations, for locking the tile connector in place when inserted into a slit of the tile.

The tile connector may be in/comprise the shape of a circular segment.

The tiles of a system may have any suitable form, such as circular, oval, squared, rectangular, pentagonal, hexagonal, and combinations thereof.

Each of the first and second connecting members may be provided with at least one aperture, and secured to the first and second tiles, respectively, by fastening means through the at least one apertures.

The number of connecting members in connection with a tile may vary. Although two may be sufficient for one tile, one, or more than two, may be used. It may be suitable to have, for example, one connector for each short side in a case of a tile having a plurality of short sides. It may be suitable with a system having a pair of connectors for each gap between adjacent tiles. Such as essentially four connectors per tile for an example with a surface comprised of squared tiles.

The invention claimed is:

1. A surface forming system intended to be supported by a structural ceiling and/or a wall of a room, the surface forming system comprising a hinge member, a first tile and a second tile, each tile comprising a front major surface, an opposing back major surface and at least one edge surface extending along the perimeter of the tile and connecting the front and back major surfaces, a first connecting member and a second connecting member, each comprising a tile connector and a pivot connector, the first and the second connecting members are made of bend metal wire, the tile connectors of the first and the second connecting members each comprise a planar portion inserted in a slit or groove of the at least one edge surface of the first and the second tiles, respectively, the pivot connectors of the first and the second connecting members each comprise at least one protruding member inserted in corresponding orifices of the hinge member whereby the pivot connector of the first and the second connecting members are pivotably connected to each other via the hinge member, wherein the tile connector of the first connecting member and the second connecting member are connected to the first tile and the second tile, respectively, and wherein the pivot connector of the first and the second connecting members are pivotably connected to each other such that the tiles are foldable relative each other.

2. The surface forming system according to claim 1, wherein the first and the second tile are comprising of compressed fibre material.

3. The surface forming system according to claim 1, wherein the hinge joint is positioned in a space formed between the at least one edge surface of the first and the second tiles.

4. The system according to claim 1, wherein the hinge member is connectable to the structural ceiling and/or the wall.

5. The system according to claim 1, wherein each of the first and the second connecting members have a lip or shoulder arranged to abut the at least one edge surface of the first and the second tiles, respectively, such that a predetermined space is formed between the at least one edge surface of the first and the second tiles.

6. The system according to claim 5, wherein the first and the second connecting members are made of sheet structure or wire structure.

7. The system according to claim 1, wherein one or both of the front major surface and the opposing back major surface of each of the first tile and the second tiles are planar.

* * * * *